United States Patent [19]

Vigliani

[11] Patent Number: 4,697,526

[45] Date of Patent: Oct. 6, 1987

[54] ARTICULATION SYSTEM FOR ARTICULATED DEPRESSED-FLOOR TRAMWAY CARRIAGES

[75] Inventor: Umberto Vigliani, Milan, Italy

[73] Assignee: Officina Meccanica della Stanga O.M.S. S.p.A., Padua, Italy

[21] Appl. No.: 826,150

[22] PCT Filed: May 28, 1985

[86] PCT No.: PCT/EP85/00254

§ 371 Date: Jan. 17, 1986

§ 102(e) Date: Jan. 17, 1986

[87] PCT Pub. No.: WO85/05602

PCT Pub. Date: Dec. 19, 1985

[30] Foreign Application Priority Data

May 30, 1984 [IT] Italy ..... 21163 A/84

[51] Int. Cl.[4] ..... B61D 17/20

[52] U.S. Cl. ..... 105/3; 105/4.2; 105/8.1; 105/199.5; 105/453; 188/59; 267/3; 280/403; 280/415 B

[58] Field of Search ..... 105/3, 4 R, 4 A, 8 R, 105/199 C, 199 S, 453, 4.1, 4.2, 4.3, 4.4, 8.1, 199.4, 199.5; 280/403, 415 B; 188/59; 267/3

[56] References Cited

U.S. PATENT DOCUMENTS

| | | | |
|---|---|---|---|
| 2,109,276 | 2/1938 | Pflager | 105/4 R |
| 2,217,034 | 10/1940 | Van Dorn | 105/4 R |
| 2,859,978 | 11/1958 | Brimhall | 105/199 C X |
| 2,901,240 | 8/1959 | Fikse | 105/453 X |
| 2,908,229 | 10/1959 | Furrer | 105/3 |
| 3,826,507 | 7/1974 | Brand et al. | 105/453 X |
| 3,961,582 | 6/1976 | Paton et al. | 105/4 R X |
| 3,974,780 | 8/1976 | Estrada | 188/59 X |
| 4,579,063 | 4/1986 | Losa et al. | 105/4 R |

FOREIGN PATENT DOCUMENTS

| | | | |
|---|---|---|---|
| 129772 | 1/1985 | European Pat. Off. . | |
| 1241479 | 6/1967 | Fed. Rep. of Germany . | |
| 2826779 | 1/1980 | Fed. Rep. of Germany | 105/4 R |
| 2357409 | 2/1978 | France . | |
| 791677 | 3/1958 | United Kingdom | 105/4 R |
| 892485 | 3/1962 | United Kingdom . | |

*Primary Examiner*—Randolph A. Reese
*Attorney, Agent, or Firm*—Charles W. Fallow

[57] ABSTRACT

The articulation system relates to articulated tramway carriages comprising at least two bodies, the opposing ends of which are connected together in an articulated manner in order to maintain substantial continuity of the walking surface, and are supported by wheels at or adjacent to the articulation zone. In the articulation system, the end of each body is supported on its own axle provided with independent wheels, the opposing bodies and the relative axles being connected together by means of a drawbar, slidable connections and/or connecting rods to jointly form a bogie with a non-rigid frame. The axle is of double swanneck shape with uprights for connecting disc brakes on the outside of the wheels.

14 Claims, 8 Drawing Figures

ARTICULATION SYSTEM FOR ARTICULATED DEPRESSED-FLOOR TRAMWAY CARRIAGES

TECHNICAL FIELD

This invention relates generally to articulated tramway carriages, and more particularly to a system for connecting together two depressed-floor carriages by means of an articulation system which allows them to follow a curved path and allows the passengers to pass through the articulated zone along a walking surface at the same level as the depressed floor of the two carriages.

BACKGROUND OF THE INVENTION

The fact that the walking surface is at a low level facilitates passenger entry and exit, thus reducing on the one hand passenger fatigue and on the other hand the halt time for their entry into the carriage, with consequent reduction in the commercial speed.

Carriages comprising two bogies with a depressed floor in the zone between the two bogies have been constructed and are in service, but the depressed floor part represents only a limited proportion of the carriage floor lying between the parts which are raised above the two end bogies.

Recently, in order to construct articulated tramcars with a depressed floor in the zone between the two motorized end bogies, use has been made of articulated systems comprising a conventional bogie with very small wheels which is disposed in proximity to the articulated connection, or comprising a traditional bogie with idle wheels and a very low central thrust bearing.

The currently known articulation systems with a depressed floor have numerous drawbacks, including the following.

- The extent by which the carriage walking surface is lowered is not such as to reach a level above the rail which allows entry to the carriage without the aid of at least one raisable or retractable step structure. The result is that the ease and speed of entry of the passengers is only slightly increased, and with it the commercial speed, due to the presence of two step rises for entry purposes.
- Care must be taken that the step structure does not emerge where raised pavements are provided at stopping points.
- Precautions must be taken against the passenger becoming caught in the step structure so that it cannot be retracted or raised, with the danger of it being able to drag the passenger along when the carriage moves.
- The use of small-diameter wheels to obtain this lowering reduces safety both with regard to the wheel loading capacity and with regard to derailment due to the reduced guiding capacity of the wheel flange in reduced-pitch bogies.
- The use of braking by means of discs when small-diameter wheels are used is difficult because of the small diameters of the discs themselves, which have to satisfy the prescribed clearances from the rail level.
- If the braking is by means of shoes acting on the wheel rolling face, it is practically impossible to use elasticized wheels with rubber inserts because of wheel heating on braking.

- The difficulty experienced by handicapped persons in entering the carriage.

SUMMARY OF THE INVENTION

The object of the present invention is to substantially improve the method of construction, operation, maintenance and utilization with respect to currently known systems, so obviating the aforesaid drawbacks by providing an articulation system for connecting together two or more bodies in such a manner as to maintain the walking surface at the same level even when passing over the articulated connection, to thus increase the proportion of depressed floor of the assembly, and enable the carriage walking surface to be lowered to a height above the rail level such as to allow direct access to the carriage, thus eliminating the retractable or raisable step structure.

More particularly, the invention relates to an articulation system for articulated depressed-floor tramway carriages with at least two bodies, the opposing ends of which are articulatedly connected together to maintain substantial continuity of the waling surface and are supported by wheels at or adjacent to the articulation zone, said system being characterized in that the end of each body is supported on its own axle provided with idle wheels, and in that the opposing bodies and the relative axles are connected together by means of a drawbar, slidable connections and/or connecting rods to jointly form a bogie with a non-rigid frame.

Preferably, each axle has a configuration, when viewed in a vertical plane, which is substantially in the form of a double swan-neck with a depressed central zone provided with a seat for rotatably supporting the relative body.

Preferably, each axle supports a substantially semi-cylindrical structure connected to the symmetrical structure supported by the other axle to form a turncage connection cover, substantially free of discontinuity, between the two carriage bodies.

As a modification, each axle supports a bellows system to form a connection cover with mobile platform footboards and provided with side protection panels in line with the side walls of the carriages in order to protect up to a certain height those members of the unconventional bogie which are exposed, for safety reasons.

Inasmuch as this invention is applicable both to tramway cars (streetcars and metro cars) and to railroad vehicles, it should be understood that "railway carriages" as used herein, is generic to all such vehicles.

BRIEF DESCRIPTION OF THE DRAWINGS

The present invention is hereinafter further clarified, with reference to the accompanying drawings.

BEST MODE OF CARRYING OUT THE INVENTION

Figure 1:
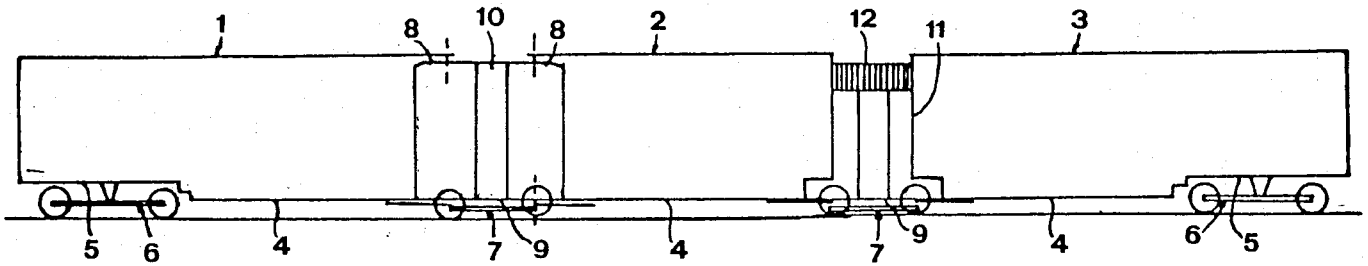
FIG. 1 is a diagrammatic elevational view of an articulated carriage formed from three bodies provided with the connection and articulation system according to the present invention.
Figure 2:
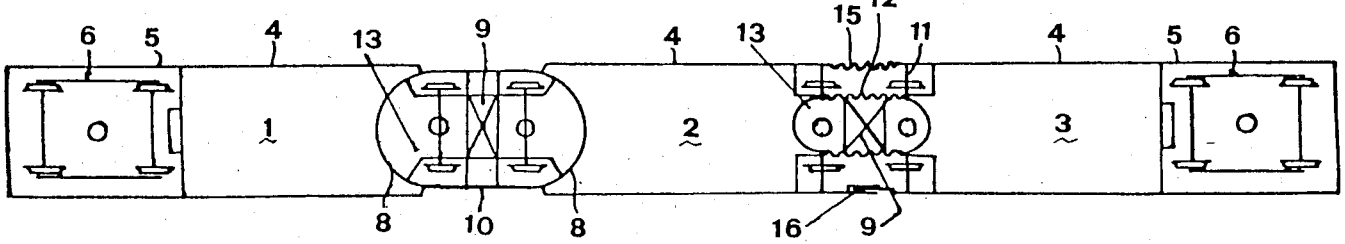
FIG. 2 is an analogous illustration to that of FIG. 1, but in plan view.
Figure 3:
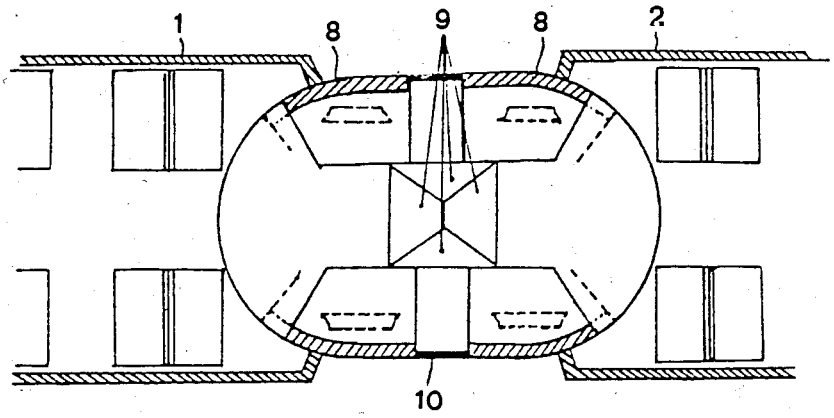
FIG. 3 is a diagrammatic plan view of the connection and articulation zone of two opposing carriages, showing a so-called turncage connection.
Figure 4:
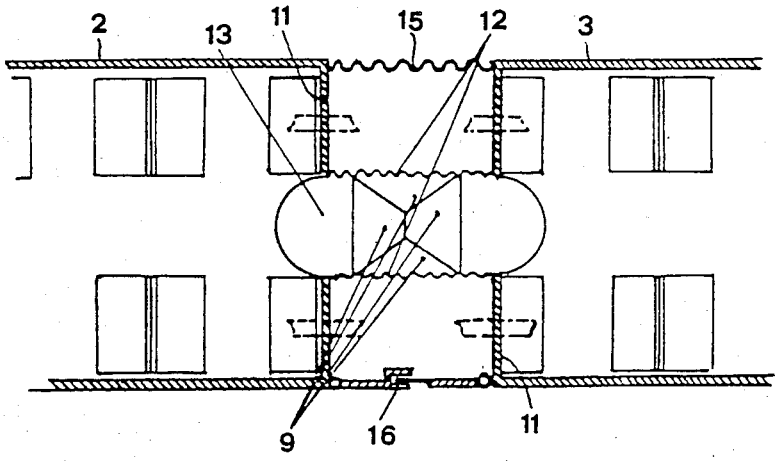
FIG. 4 is an illustration analogous to FIG. 3, but showing a bellows connection.
Figure 5:
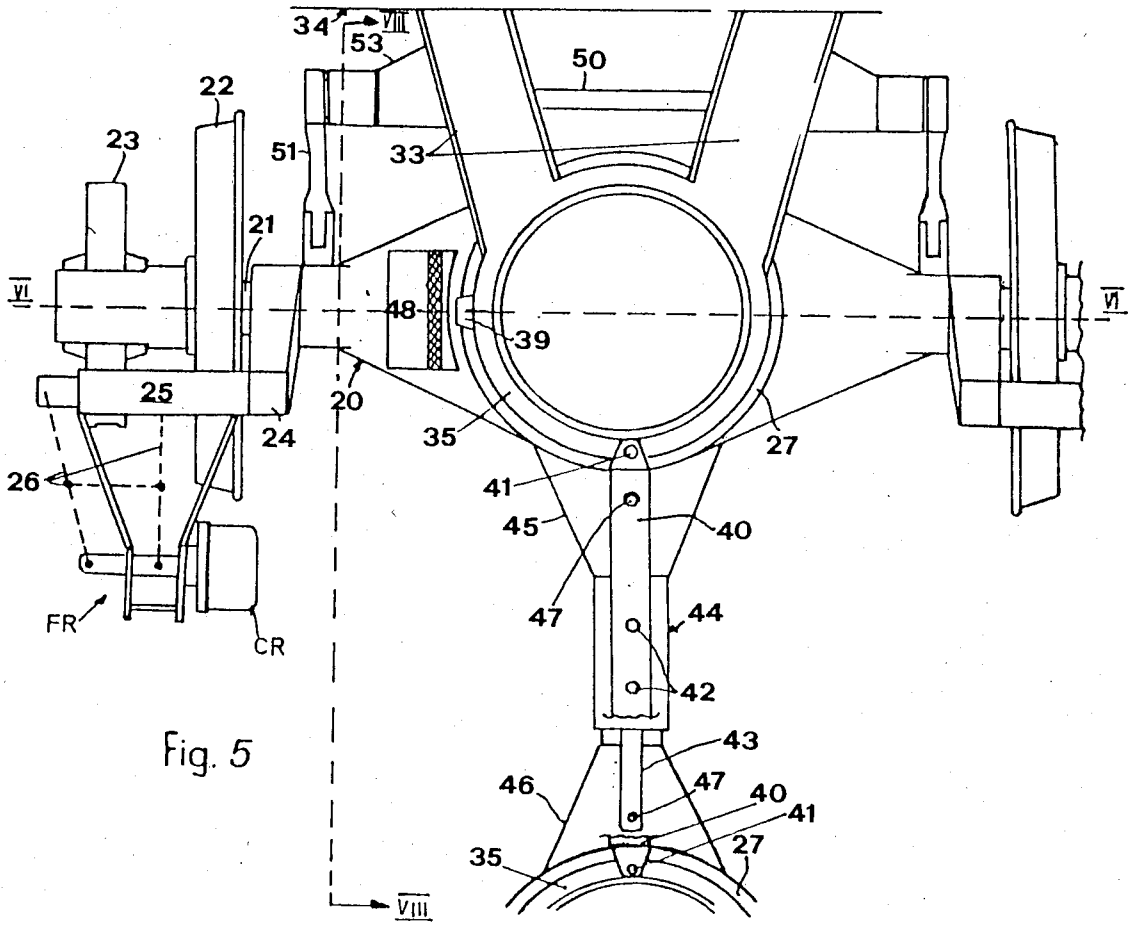
FIG. 5 is a partly sectional plan view, taken transversely to the carriage, showing the axle with idle wheels.
Figure 6:
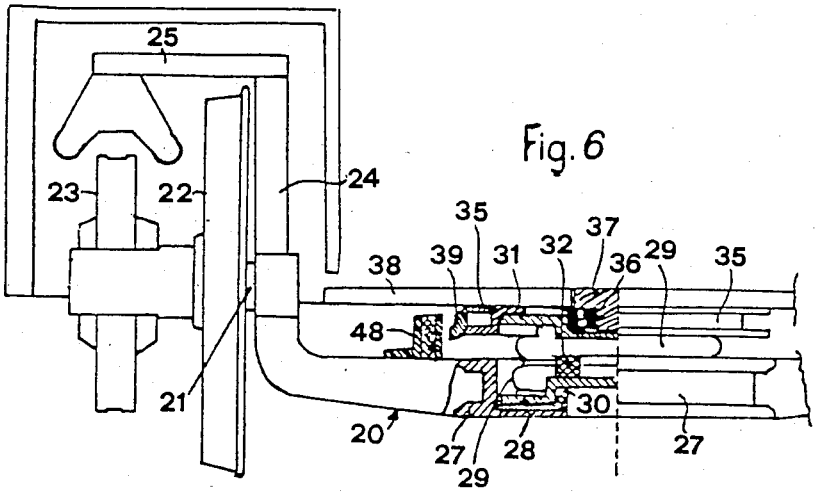
FIG. 6 is a vertical section through the axle on the line VI—VI of FIG. 5.
Figure 8:
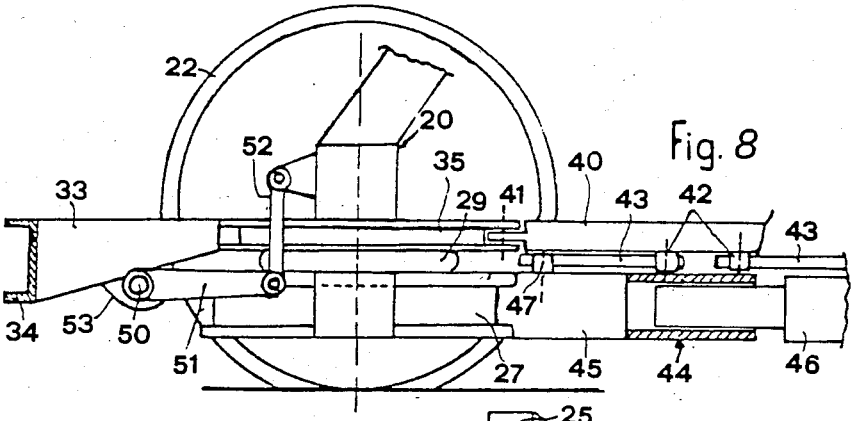
FIG. 8 is a side elevation on the line VIII—VIII of FIG. 5, showing the telescopic tube in section.
Figure 7:
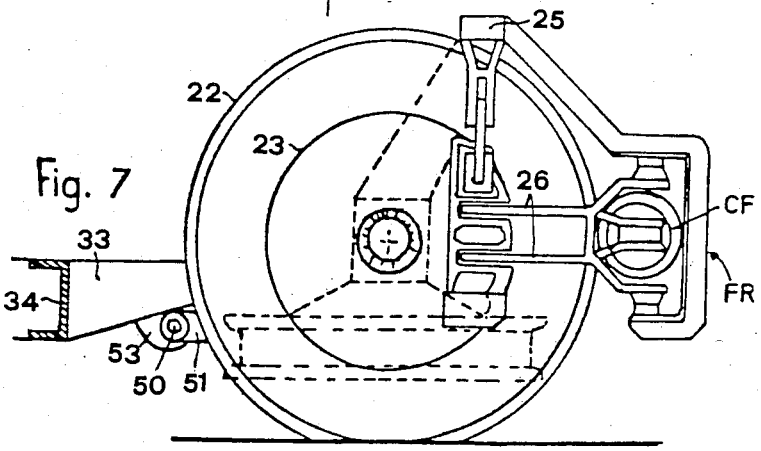
FIG. 7 is a side elevation of the axle of FIG. 5.

With reference to the drawings in detail, FIGS. 1 and 2 show a diagrammatic example of an articulated carriage comprising three bodies 1, 2 and 3, each provided with a depressed floor 4, forming a constant level which is raised only at 5 in positions corresponding with the two end bogies 6 which are located below the bodies 1 and 3. In a position corresponding with each articulation system between the bodies 1 and 3 and the central body 2, there are disposed the central bogies 7 formed from two axles connected together in such a manner as to constitute a non-rigid unconventional bogie with idle wheels, according to the invention. The ends of the bodies 1, 2 and 3 rest on these axles. The system is completed by two semi-cylindrical portals 8 connected together by the articulated footboards 9 to provide floor continuity, and by the elastic wall 10 (these being shown in the connection zone between the body 1 and body 2), or is alternatively completed, as a modification, by two body end walls 11 connected to the bellows interconnection piece 12, turntable footboards 13 and mobile platform footboards 9 with side protection panels of bellows type 15 or telescopic type 16 hinged to the ends of the side walls, which protection panels can be limited in height to the extent necessary for protecting the public from the exposed bogie parts.

The articulation and mechanical connection system between two bodies indicated by 7 in FIGS. 1 and 2 is more apparent from an examination of FIGS. 5, 6, 7 and 8.

The reference numeral 20 indicates an axle according to the invention in the shape of a double swan-neck, from the ends of which there project journals 21 which support the wheels 22, and each of which carries, on the outside of the wheels, a disc 23 for the wheel disc-braking system FR, comprising a brake cylinder CF. Each wheel 22 is mounted, rigidly together with its disc, on the journal 21 by means of bearings in order to rotate independently from the other wheel of the axle. From each of the two ends of the axle 20 there also extends an upright 24 for carrying the projecting support arm 25 for the lever system 26 which operates the brake pads of the discs 23.

At the depressed center of the axle 20 there is disposed a seat 27 which internally carries a lower ring 28 of a preferably pneumatic suspension 29, the ring being supported on the axle by a ball bearing 30 to allow the suspension to rotate about the seat 27. Upperly, and rigid with it, the suspension 29 carries a ring 31 on which the body structure 34 rests by way of a support ring 35 made rigid with the body by means of the brackets 33. The suspension 29 carries the normal end-of-travel buffers 32. In the support ring 35 there is housed a bearing 36 with both axial and radial bearing capacity and supporting the lower central pivot 37 of that half of the articulation turntable 38 relative to one of the bodies.

The bodies are connected together by a drawbar 40 pivoted at 41 on the support ring 35. The drawbar 40 is connected by one of its rigid pins 42 to the connecting rods 43 which transmit to the bodies the longitudinal forces due to the motion and braking resistance. The axles 20 are connected together by a telescopic cylindrical connection 44 rigid with the axles 20 by way of the structures 45 and 46, which are themselves rigid with the axle seat 27.

The longitudinal connection of the axle is completed by the pins 47 rigid with the structures 45 and 46 and connected to the second end of the connecting rods 43. The telescopic connection thus ensures parallelism of the axles, prevents the axles rotating about the wheel axis, allows the axles to make skew movements, and allows the making of the longitudinal movements required by the movements of the drawbar 40 or of the connecting rods 43.

The body support ring 35 comprises a counteracting shoe 39 cooperating with a relative buffer 48 rigid with the axle 20 in order to limit the relative oscillations made by each axle in directions parallel to the wheel axis beyond the elastic limits allowed by the transverse elasticity of the suspension 29.

A torsion bar 50 connected by the arms 51 and connecting rods 52 to the axle 20 can be provided for aiding stabilization of the bodies, in particular of the intermediate body which rests on two points.

The torsion bar, disposed close to the body, reacts against the body support brackets 33 by way of the supports 53.

Floor continuity is provided by the turntable platform 38 rigid with the pivot 37 and by the articulated footboards 9, it therefore being apparent from the aforegoing description that the tramway carriage constructed with the axle according to the invention, comprising idle wheels, enables the floor to be depressed continuously to the same level, including at the articulation systems between the bodies, with the exception of the positions corresponding with the end bogies. The advantages obtained are as follows:

- substantial increase in the ease and speed of passenger entry, with definite reduction in the halt time to the advantage of the commercial speed;
- simplification of the carriage construction by eliminating the retractable or raisable step mechanism:
- simplification of the car operating system by eliminating the automatic devices necessary for governing the step movements when raised pavements are present at stopping points;
- increase in operating safety, as no special arrangements are necessary for protection against misure of the step structure by passengers;
- facility for easy entry of handicapped persons in wheelchairs.

The system has no limitations with regard to wheel diameter, with substantial advantages in terms of wheel loading capacity and wear and in terms of the guiding function required of the wheel flange.

The system can use wheels of the same diameter as the wheels of conventional bogies, which simplifies maintenance as the wheels can be tired and provided with an elasticized part with rubber types and inserts which are equal for the entire carriage.

The system allows disc brakes to be mounted without diameter limitation, thus providing maximum reliability in braking.

The use of disc brakes enables the wheels to be elasticized as they do not become heated, there being no need for the action of friction by the brake shoes on the tyres for braking purposes.

The use of independently wheeled double swan-neck axles connected together to form an unconventional bogie enables the carriage articulation system to undergo good curving, and allows passengers to pass through the articulated zones along a walking surface at the same level as the depressed floor of the articulated carriage.

I claim:

1. In a suspension system for a pair of articulated depressed-floor railway carriages, of the type wherein adjacent car ends are pivotally interconnected by means of a drawbar, each of said ends is supported by a single-axle bogie, and each of said bogie comprises a dropped-center axle and a pair of wheels mounted for free independent rotation thereon, the improvement comprrising (a) a single resilient suspension element interposed between said car body and said axle at the center thereof, (b) means for permitting the axle to pivot about a vertical axis relative to said car body, and (c) a constraint for preventing rotation of said axle around the rotational axis of said wheels.

2. The invention of claim 1 wherein the axle has a depressed central zone and further comprises a seat centrally located within said zone for supporting said suspension and pivoting means.

3. The invention of claim 1 wherein the means for permitting the axle to pivot is a thrust bearing interposed between the car body and the axle at the center thereof.

4. The invention of claim 1 wherein said means central resilient suspension element is capable of yielding torsionally and the means permitting the axle to pivot is the suspension element itself.

5. The invention of claim 1 wherein the suspension is pneumatic.

6. The invention of claim 5 further comprising means for transmitting longitudinal forces between the axle and its respective car body.

7. The invention of claim 6 wherein said force transmitting means comprises a connecting rod pivotally connected at one end to the axle and pivotally connected at the other end to the car body.

8. The invention of claim 1 wherein said constraint comprises a pair of tubular telescoping longitudinal elements each directly connected to a respective one of said axles.

9. The invention of claim 1 further comprising a shoe and a seat in proximity to the shoe for contacting the same to prevent excessive lateral movement of the axle with respect to the car body, the shoe and seat being disposed respectively one on the axle and one on the car body.

10. The invention of claim 1 further comprising a brake disc mounted to each of said idler wheels.

11. The invention of claim 10 further comprising braking means for engaging said brake disc, said braking means being supported from the axle.

12. The invention of claim 1 further comprising an anti-sway torsion bar for at least one of said axles.

13. The invention of claim 1 wherein each axle supports a semi-cylindrical structure connected to a like structure of the other axle to form a turn-cage connection cover substantially free of discontinuity between the two car bodies.

14. The invention of claim 1 further comprising a bellows connection forming a connection cover with mobile platform foot boards and having side protection panels in line with side walls of the car body to shield exposed portions of the bogie.

* * * * *